US009033143B2

(12) United States Patent
Tang et al.

(10) Patent No.: US 9,033,143 B2
(45) **Date of Patent: *May 19, 2015**

(54) CREDIT-CARD-SIZED CARRIER OF BOTH STANDARD AND MICRO FORM-FACTOR FLASH-MEMORY CARDS

(75) Inventors: Choon Tak Tang, Irvine, CA (US); George K. L. Shiu, South Pasadena, CA (US)

(73) Assignee: Kingston Technology Corporation, Fountain Valley, CA (US)

( * ) Notice: Subject to any disclaimer, the term of this patent is extended or adjusted under 35 U.S.C. 154(b) by 101 days.

This patent is subject to a terminal disclaimer.

(21) Appl. No.: 12/824,626

(22) Filed: Jun. 28, 2010

(65) Prior Publication Data

US 2010/0258459 A1 Oct. 14, 2010

Related U.S. Application Data

(63) Continuation of application No. 12/134,024, filed on Jun. 5, 2008, now Pat. No. 7,757,847.

(51) Int. Cl.
*B65D 85/00* (2006.01)
*A45C 11/18* (2006.01)

(52) U.S. Cl.
CPC ..... *A45C 11/18* (2013.01); *A45C 11/182* (2013.01); *A45C 2011/188* (2013.01)

(58) Field of Classification Search
CPC ... A45C 11/18; A45C 11/182; A45C 2011/18
USPC ..... 206/701, 477, 478, 480, 482, 493, 706, 206/707, 307.1, 307; 211/41.12
See application file for complete search history.

(56) References Cited

U.S. PATENT DOCUMENTS

| | | | | |
|---|---|---|---|---|
| 4,724,956 | A | 2/1988 | Ozeki | |
| 4,916,434 | A | 4/1990 | McNeely | |
| 5,155,663 | A * | 10/1992 | Harase | 361/679.31 |
| 5,161,827 | A | 11/1992 | Grosso | |
| 5,373,944 | A | 12/1994 | Ishitsuka | |
| 5,938,010 | A | 8/1999 | Osterbye | |
| 6,097,605 | A * | 8/2000 | Klatt et al. | 361/737 |

(Continued)

OTHER PUBLICATIONS

Proporta Ltd., Aluminum Memory/SIM Card Holder Product Info, 2008.

(Continued)

*Primary Examiner* — Andrew Perreault
(74) *Attorney, Agent, or Firm* — Sawyer Law Group, P.C.

(57) ABSTRACT

A multi-standard flash-memory-card carrier is about the same size as a thick credit card and fits into a wallet. The multi-standard flash-memory-card carrier has bays that accept flash-memory cards. Larger bays on one side receive SD cards and a Memory Stick Duo card, while micro bays on another side of the carrier receive microSD cards and Memory Stick Micro cards. A carrier spine sandwiched between top and bottom covers has openings forming the bays. Spring-clip tabs on spring-clip fingers fit into notches on the side of the flash-memory cards to secure the flash-memory cards into the multi-standard flash-memory-card carrier to prevent loss. The spring-clip fingers are movable parts of the carrier spine that are deformed during insertion of the flash-memory cards. Both micro and standard flash-memory cards can be carried in the same multi-standard flash-memory-card carrier that can be placed in plastic sleeves for credit cards in a person's wallet.

11 Claims, 8 Drawing Sheets

(56) References Cited

U.S. PATENT DOCUMENTS

| | | | | |
|---|---|---|---|---|
| 6,112,901 | A * | 9/2000 | Noga et al. | 206/723 |
| 6,230,885 | B1 * | 5/2001 | Rochelo et al. | 206/308.3 |
| 6,427,836 | B1 | 8/2002 | Bolanos | |
| 6,587,348 | B2 | 7/2003 | Kondo | |
| 6,601,329 | B2 | 8/2003 | Vaudreuil | |
| 6,724,618 | B1 | 4/2004 | Jenkins et al. | |
| 6,783,000 | B1 * | 8/2004 | Price et al. | 206/308.1 |
| 6,908,038 | B1 | 6/2005 | Le | |
| 6,920,338 | B2 | 7/2005 | Engstrom et al. | |
| 7,291,019 | B2 | 11/2007 | Nishizawa et al. | |
| 7,357,331 | B2 | 4/2008 | Blossom | |
| 2005/0077350 | A1 | 4/2005 | Courtion et al. | |
| 2005/0252969 | A1 | 11/2005 | Wu | |
| 2005/0258068 | A1 * | 11/2005 | Chien | 206/701 |
| 2006/0144751 | A1 | 7/2006 | Tsang | |
| 2008/0007905 | A1 | 1/2008 | Wilcox et al. | |
| 2008/0087731 | A1 | 4/2008 | Gonzalez et al. | |
| 2008/0173598 | A1 * | 7/2008 | Fiorentino | 211/41.12 |
| 2009/0301909 | A1 | 12/2009 | Tang et al. | |

OTHER PUBLICATIONS

PDAir, SD and SIM Card Wallet, 2006.

* cited by examiner

CREDIT-CARD-SIZED CARRIER OF BOTH STANDARD AND MICRO FORM-FACTOR FLASH-MEMORY CARDS

CROSS-REFERENCE

Under 35 U.S.C. 120, this application is a continuation application and claims priority to U.S. application Ser. No. 12/134,024, filed on Jun. 5, 2008, entitled "Credit-Card-Sized Carrier of Both Standard and Micro Form-Factor Flash-Memory Cards", all of which is incorporated herein by reference.

FIELD OF THE INVENTION

This invention relates to electronics carriers, and more particularly to wallet-sized carriers for carrying small flash-memory cards.

BACKGROUND

FLASH Small flash-memory cards have become wildly popular and have replaced floppy disks for data transport. Falling prices and advances in technology for flash-memory chips have allowed for larger memory capacities in multiple, diverse form factors, while advances in chip packaging have allowed for smaller physical sizes of flash-memory cards.

A flash-memory chip may be soldered to a printed-circuit board (PCB) or a flex carrier substrate that is then encased in a plastic shell that exposes metal contacts. The metal contacts make contacts with a connector plug when the flash-memory card is plugged into a host, such as a personal computer (PC), cell phone, digital camera, or other computing device. A flash controller may be integrated with the flash-memory chip, or may be a separate chip soldered to the PCB or flex carrier. For writes, the flash controller receives commands, address, and data carried from the host over a host bus to the metal contacts, and sends corresponding control, address, and data signals to the flash-memory chip.

A number of protocols are used for the host bus, and standards have been developed that specify the physical dimensions of the device as well as the host-bus protocol. Older standards such as compact-flash (CF) specified large, thick devices, while more recent standards such as Secure Digital (SD) and Sony's Memory Stick significantly reduced the device thickness.

Further improvements in packaging and device construction have enabled even smaller flash-memory cards. An extension of SD known as microSD yields a flash-memory card about the size and thickness of a US dime coin, although the microSD card is rectangular and lighter than the dime. An extension of Sony's Memory Stick, known as a Memory Stick Micro (M2) is similar in size and thickness.

FIG. 1 shows several prior-art flash-memory cards. SD card 36 is a Secure Digital (SD) card that has a series of metal contacts 14 exposed along one edge. Metal contacts 14 mate with socket contacts in a host when SD card 36 is inserted into a host. Metal contacts 14 include power, ground, and other signals such as data lines, a clock, command, and card-detect signals.

Memory Stick 38 is a Memory Stick Duo or PRO Duo flash-memory card. SD card 36 and Memory Stick 38 are mid-generation devices and are larger in size, being roughly an inch in length and about 2 mm in thickness.

Newer-generation devices include Memory Stick Micro 32 (M2) and microSD card 34. These devices are about a quarter of the size of earlier-generation cards, such as SD card 36 and Memory Stick 38. MicroSD card 34 has a reduced thickness of only 1 mm, while Memory Stick Micro 32 is 1.2 mm in thickness. Metal contacts 16 are smaller, and may have longer contacts for power and ground to connect power and ground before other signals are connected during insertion.

FIG. 2 highlights a problem with the smaller flash-memory cards. The extremely small size of microSD card 34 (the size of a fingernail) makes accidental loss of the card more likely than for the larger cards. MicroSD card 34 could slip out of a person's hand, or pass through a small hole in a person's pocket without notice. Memory Stick Micro 32 or microSD card 34 could easily be lost on a messy desk at work or at home.

Loss of a flash memory card is quite undesirable, not just due to the cost of the flash device itself. The data stored on the flash memory card may be critical data. Loss of such critical data may lead to identity theft or compromised trade secrets. Address and phone lists of customers could be useful to a competitor. A spammer may use a list of email addresses found on a lost flash-memory card, to the embarrassment of the owner of the lost flash-memory card.

MicroSD card 34 could be inserted into an adapter for a larger format, such as an adapter between microSD card 34 and SD card 36. However, the size of SD card 36 is still somewhat small. Credit-card-sized carriers are available for carrying a car key in a person's wallet for emergencies, and a similar carrier could be used for carrying SD card 36 in a wallet. However, the many standards for micro flash-memory cards make a multi-standard wallet carrier more desirable.

What is desired is a multi-standard carrier that fits in a person's wallet. A multi-standard carrier that can carry multiple kinds of flash-memory cards is desirable. A multi-standard carrier that has a size similar to a credit card is desirable so that the carrier could be placed into a person's wallet in place of a credit card. A credit-card-sized carrier is desirable for transporting micro flash-memory cards so that the micro flash-memory cards are not lost during transport.

DETAILED DESCRIPTION

The present invention relates to an improvement in flash-memory-card wallet carriers. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 3:
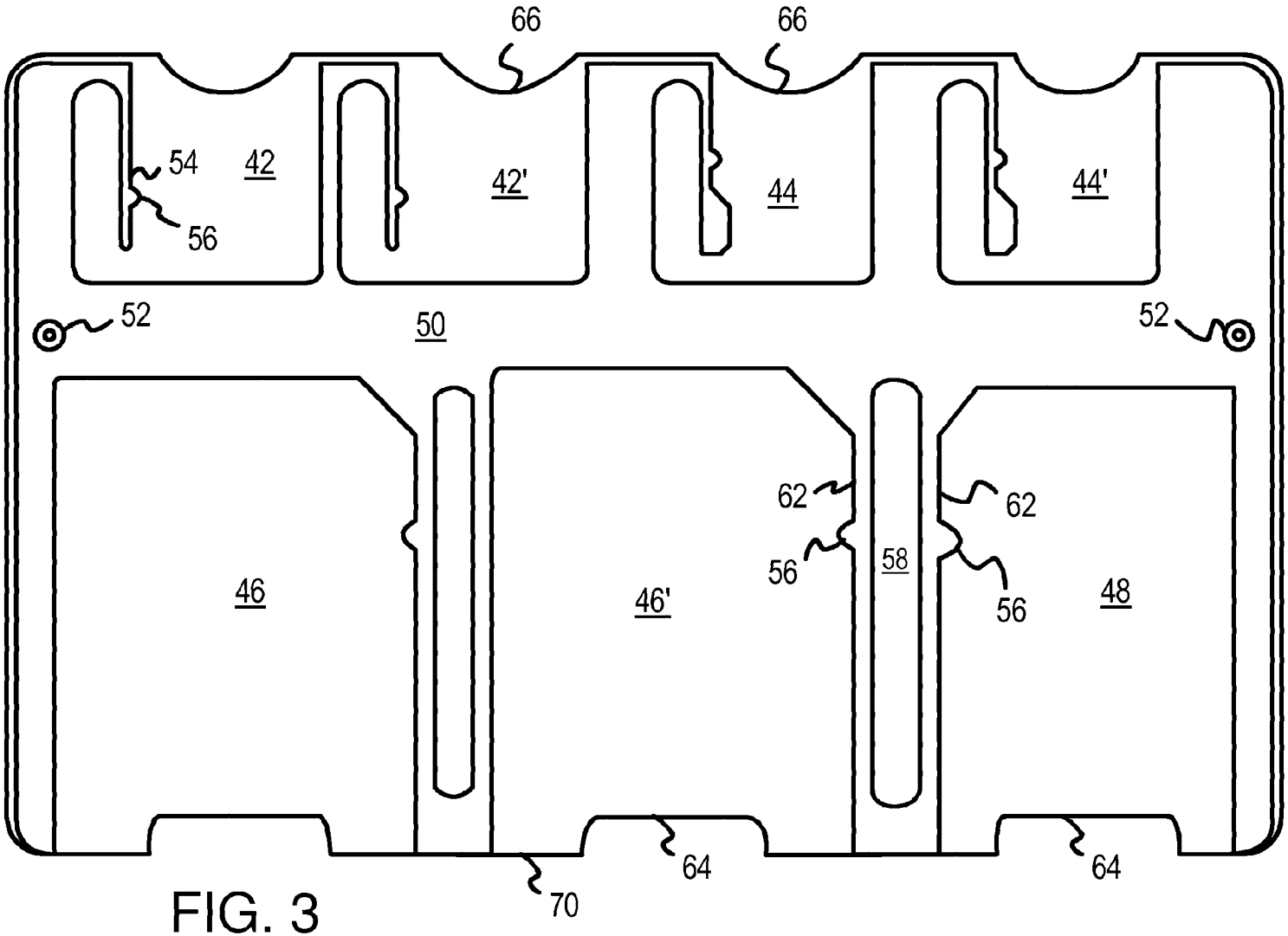
FIG. 3 shows a multi-standard flash-memory-card carrier with its top cover removed.

FIG. 3 shows a multi-standard flash-memory card carrier with its top cover removed. A multi-standard flash-memory card carrier has a length and width that are approximately the same as that of a credit card, 8.5 cm by 5.4 cm, although the dimensions do not have to be exactly the same as a credit card, but could be smaller or slightly larger and still fit within a plastic sleeve for credit cards that are commonly found in wallets.

The thickness of the multi-standard flash-memory card carrier is greater than the thickness of a credit card so that the multi-standard flash-memory card carrier can carry flash-memory cards that are up to 2 mm thick. For example, the multi-standard flash-memory-card carrier may be 3 or 4 mm thick, and still fit within a wallet.

The multi-standard flash-memory-card carrier has three larger bays 46, 46', 48 and four micro bays 44, 44', 42, 42', allowing up to 7 flash-memory cards to be carried at one time. Carrier spine 50 is sandwiched between bottom plate 70 and top plate 30 (not shown). Carrier spine 50 has seven openings that form bays 46, 46', 48, 44, 44', 42, 42.

SD card bays 46, 46' are each sided to accept SD card 36, while Memory Stick Duo/PRO Duo bay 48 is sided to accept Memory Stick 38. One side of the multi-standard flash-memory-card carrier can thus accept up to 3 of the larger flash-memory-card.

MicroSD bays 44, 44' are each sized to accept microSD card 34, while Memory Stick Micro (M2) bays 42, 42' are each sized to accept Memory Stick Micro 32. Up to four micro flash-memory cards can be carried at one time by the multi-standard flash-memory-card carrier. The larger credit-card size of the multi-standard flash-memory-card carrier helps prevent inadvertent loss of the tiny microSD card 34 or Memory Stick Micro 32, and allows for convenient transport in a person's wallet, along with other credit cards, ID cards, family photographs, or other items carried in a wallet.

Figure 1:
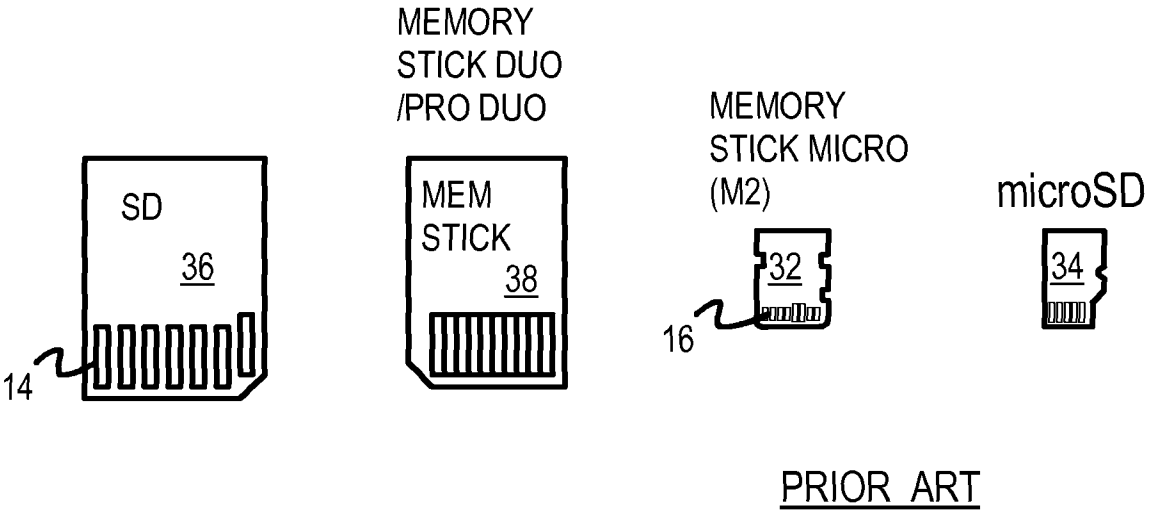
PRIOR ART FIG. 1
FIG. 1 shows several prior-art flash-memory cards.
Figure 2:
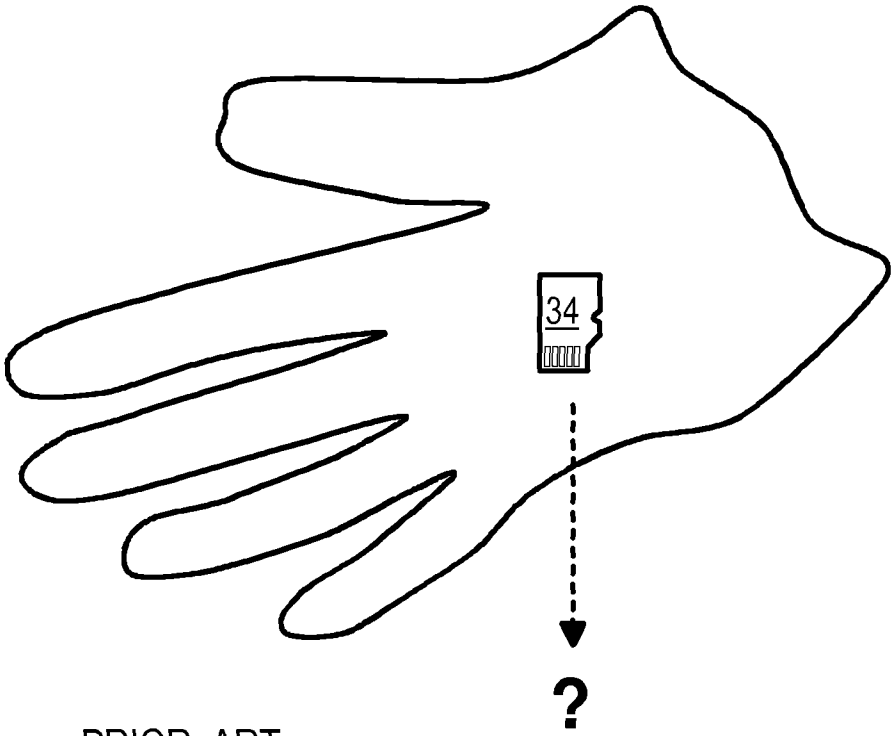
PRIOR ART FIG. 2
FIG. 2 highlights a problem with the smaller flash-memory cards.

The flash-memory cards carried in the multi-standard flash-memory-card carrier could slip out and still be lost if they were not secured. Spring-clip fingers 54 are formed on carrier spine 50 to secure flash-memory cards being carried. Each spring-clip finger 54 has spring-clip tab 56 formed thereon. Spring-clip tab 56 is a rounded extension or knob that is sized to fit within a notch on the side of microSD card 34 (FIG. 1). When microSD card 34 is inserted into microSD bay 44, spring-clip finger 54 is deformed and flexes to the side to allow the straight edge of microSD card 34 to pass along. Once the notch in the side of microSD card 34 aligns with spring-clip tab 56, then spring-clip finger 54 snaps back into a less-strained or less deformed position to lock spring-clip tab 56 into the notch. Thus microSD card 34 is secured into the multi-standard flash-memory-card carrier.

Once microSD card 34 is inserted into microSD bay 44, microSD card 34 may be removed by the person pulling microSD card 34 outward, gripping microSD card 34 at micro gripping cutouts 66 with the person's fingers. Memory Stick Micro 32 also has such notches that accept spring-clip tab 56 when Memory Stick Micro 32 is fully inserted into Memory Stick Micro (M2) bay 42.

The larger SD card bays 46, 46' and Memory Stick Duo/PRO Duo bay 48 have spring sides 62 formed around oval cavity 58 in carrier spine 50. Spring-clip tabs 56 move inward into oval cavity 58 as spring side 62 are deformed inward by the straight sides of SD card 36 or Memory Stick 38 until the notch aligns with spring-clip tab 56 and spring side 62 can snap back into a less-deformed position. Thus SD card 36 and Memory Stick 38 are secured into the multi-standard flash-memory-card carrier by spring-clip tab 56 fitting into notches on the flash-memory cards.

SD card 36 may be removed by the person pulling SD card 36 outward, gripping SD card 36 at larger gripping cutouts 64 with the person's fingers. Memory Stick 38 may be removed in a similar manner using larger gripping cutouts 64 in Memory Stick Duo/PRO Duo bay 48.

Figure 5:
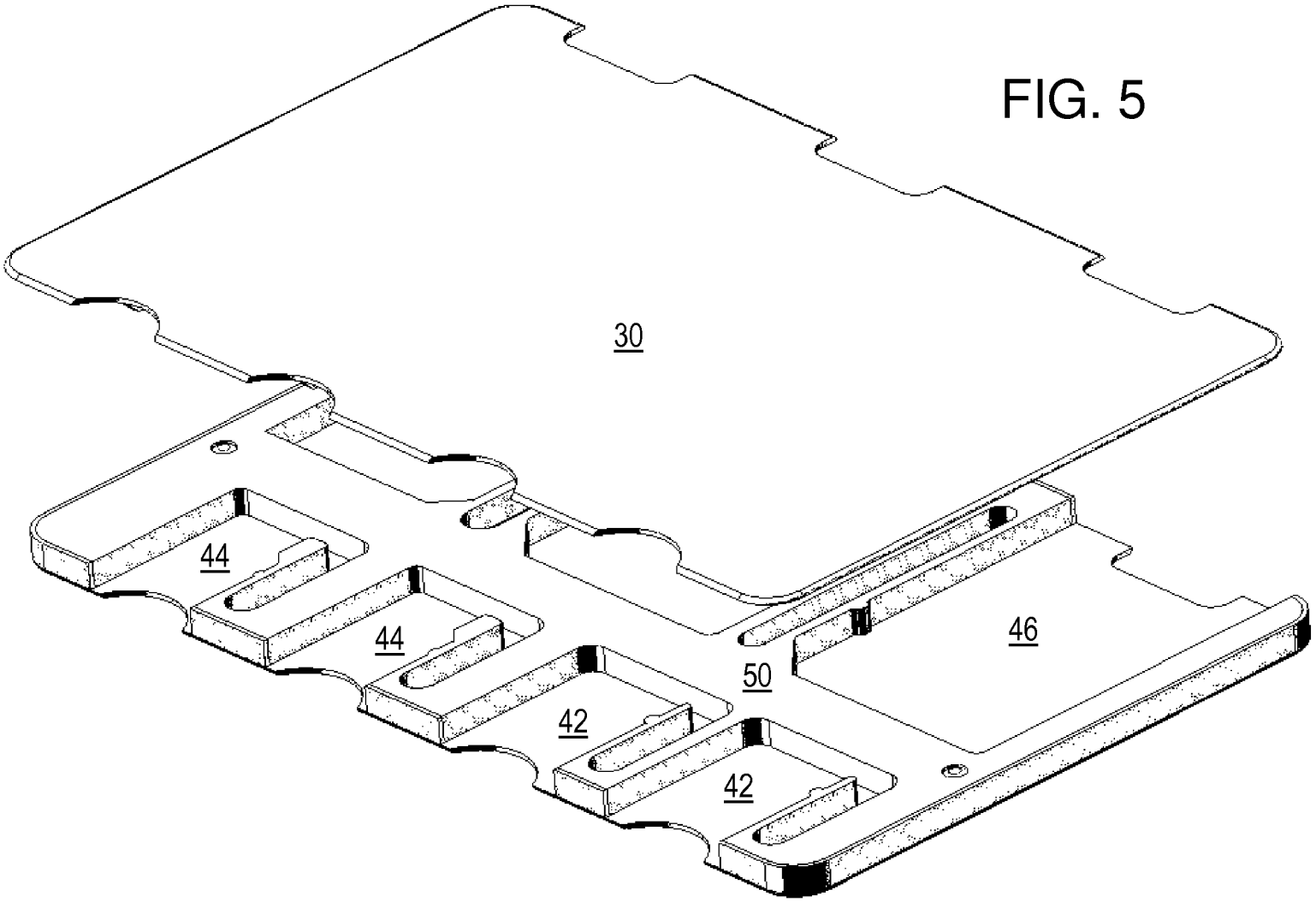
FIG. 5 is an exploded view of the multi-standard flash-memory-card carrier showing the micro bays.

Cover connection points 52 may be a weld joint, glue tab, plastic clip, screw, bolt, alignment hole, or other mechanism to connect carrier spine 50 to bottom plate 70 and/or to top plate 30 (FIG. 5). Ultrasonic welding may be used to melt cover connection points 52 when bottom plate 70 or top plate 30 is pressed into carrier spine 50, forming a bond.

Figure 4A:
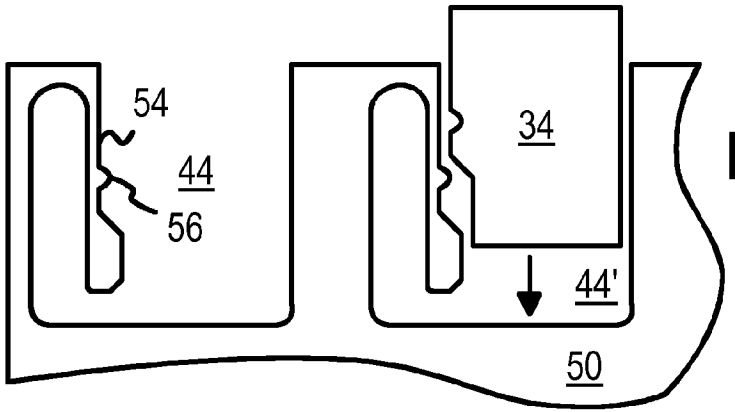
FIGS. 4A-C highlight insertion of a microSD card into a microSD bay in the multi-standard flash-memory-card carrier.
Figure 4B:
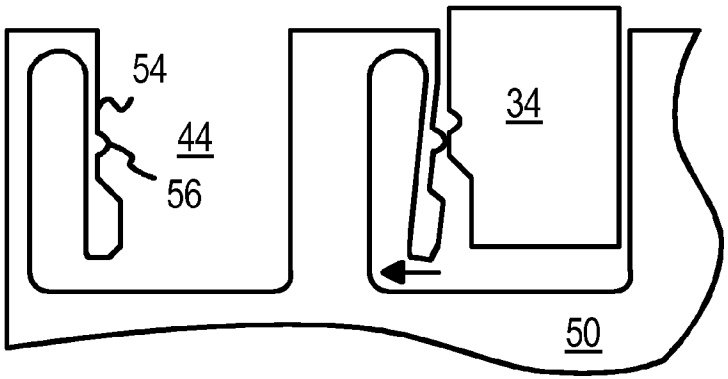
Figure 4C:
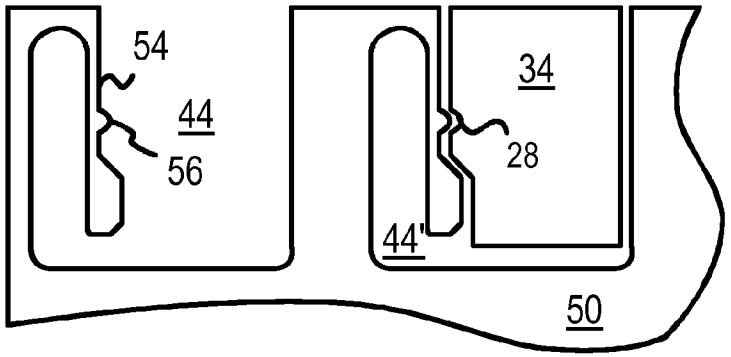

FIGS. 4A-C highlight insertion of a microSD card into a microSD bay in the multi-standard flash-memory-card carrier. In FIG. 4A, microSD card 34 is being pushed into microSD bay 44' in carrier spine 50 (only partially shown). In FIG. 4B, as microSD card 34 is pushed further into microSD bay 44' past spring-clip tab 56, spring-clip finger 54 is deformed outward to the side as spring-clip tab 56 slides along the straight side of microSD card 34. In FIG. 4C, once microSD card 34 is pushed farther into microSD bay 44', notch 28 in the side of microSD card 34 aligns with spring-clip tab 56, allowing spring-clip tab 56 to snap into notch 28. The pressure from deformation of spring-clip finger 54 locks spring-clip tab 56 into notch 28. Thus microSD card 34 is secured into microSD bay 44' by spring-clip finger 54 and spring-clip tab 56.

The sides of spring-clip tab 56 can be tapered to facilitate a person to more easily pull microSD card 34 out of microSD bay 44'.

FIG. 5 is an exploded view of the multi-standard flash-memory-card carrier showing the micro bays. Top plate 30 is to be attached to carrier spine 50 during assembly, while still allowing spring-clip fingers 54 (FIG. 3) to move. MicroSD bays 44, 44' and Memory Stick Micro (M2) bays 42, 42' are visible on this edge of the multi-standard flash-memory-card carrier.

Figure 6:
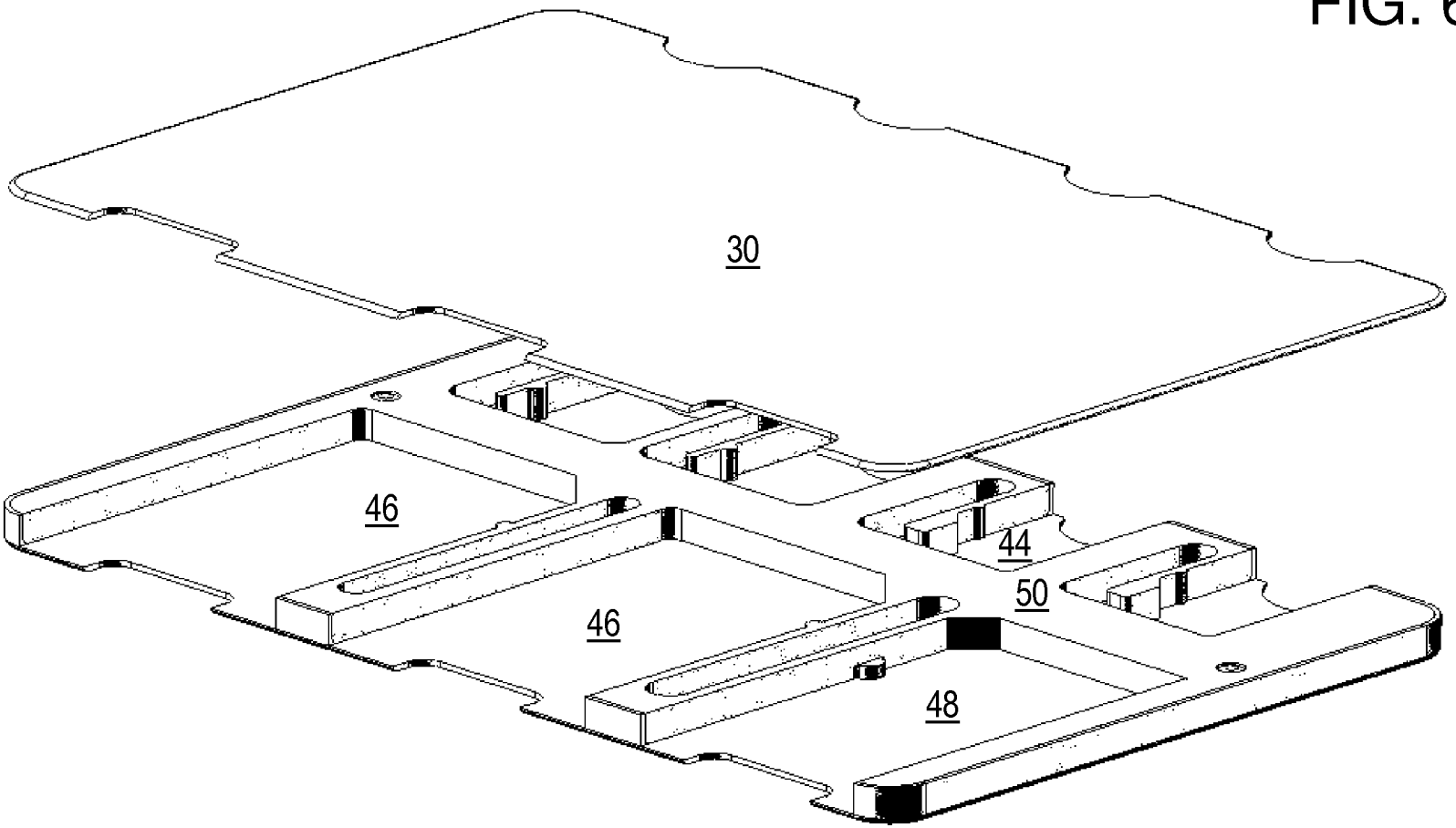
FIG. 6 is an exploded view of the multi-standard flash-memory-card carrier showing the larger bays.

FIG. 6 is an exploded view of the multi-standard flash-memory-card carrier showing the larger bays. Top plate 30 is to be attached to carrier spine 50 during assembly, while still allowing spring sides 62 to move. SD card bays 46, 46' and Memory Stick Duo/PRO Duo bay 48 are visible on this edge of the multi-standard flash-memory-card carrier. Memory Stick Micro (M2) bay 42 is on the other side of the multi-standard flash-memory-card carrier.

Since the notch on Memory Stick 38 is only shallow, spring-clip tab 56 on spring side 62 in Memory Stick Duo/PRO Duo bay 48 is only shallow, as can be seen in FIG. 6. Other spring-clip tabs 56 are more prominent in SD card bays 46, 46' and Memory Stick Micro (M2) bay 42.

Figure 7:
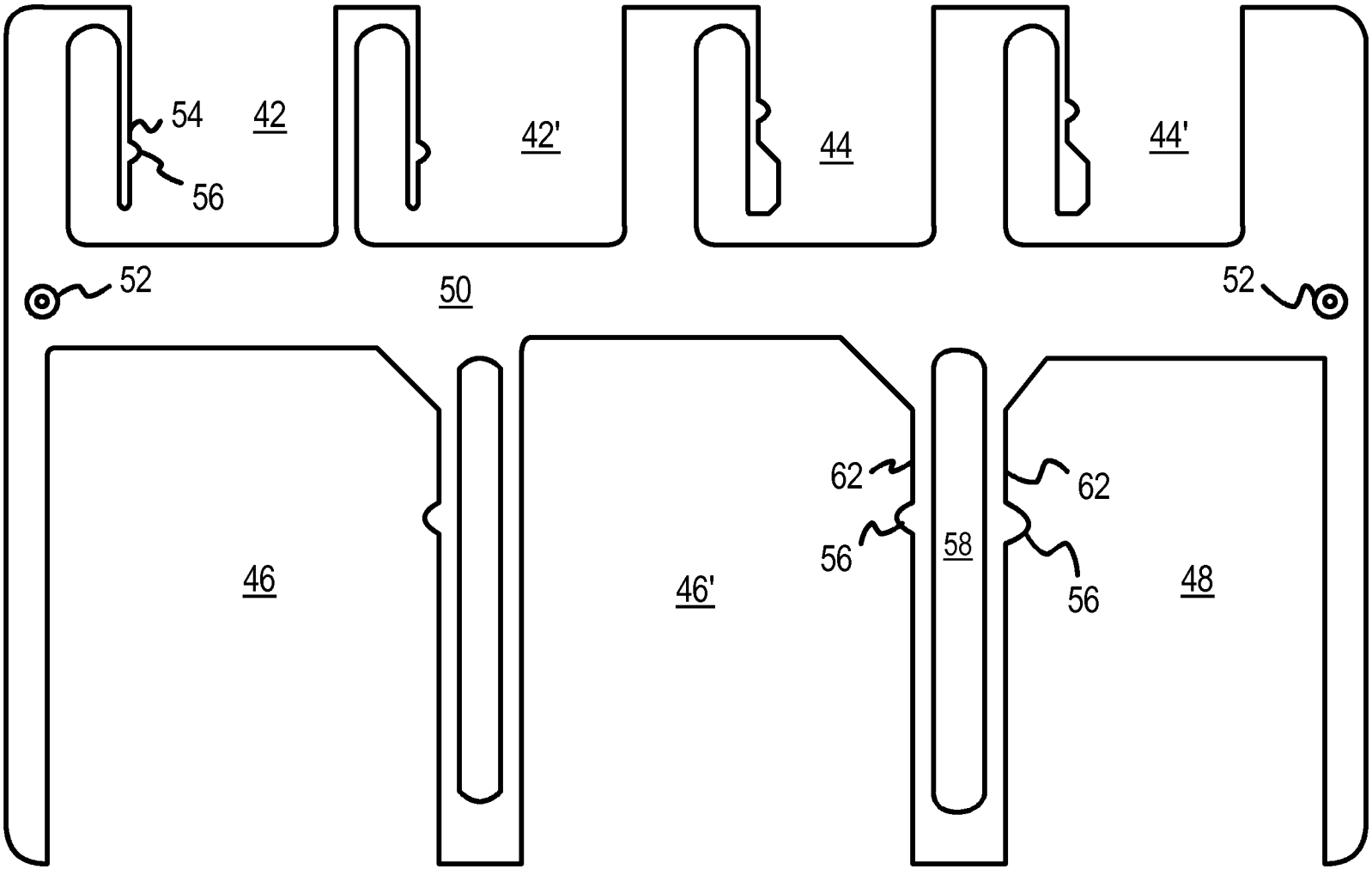
FIG. 7 shows the carrier spine in more detail.

FIG. 7 shows the carrier spine in more detail. Top plate 30 and bottom plate 70 are not shown in FIG. 7, but are attached by welding to cover connection points 52. Spring-clip fingers 54 and spring sides 62 move sideways when flash-memory cards are being inserted due to the force of the straight sides of the flash-memory cards on spring-clip tabs 56. Spring side 62 moves inward into oval cavity 58.

Figure 8:
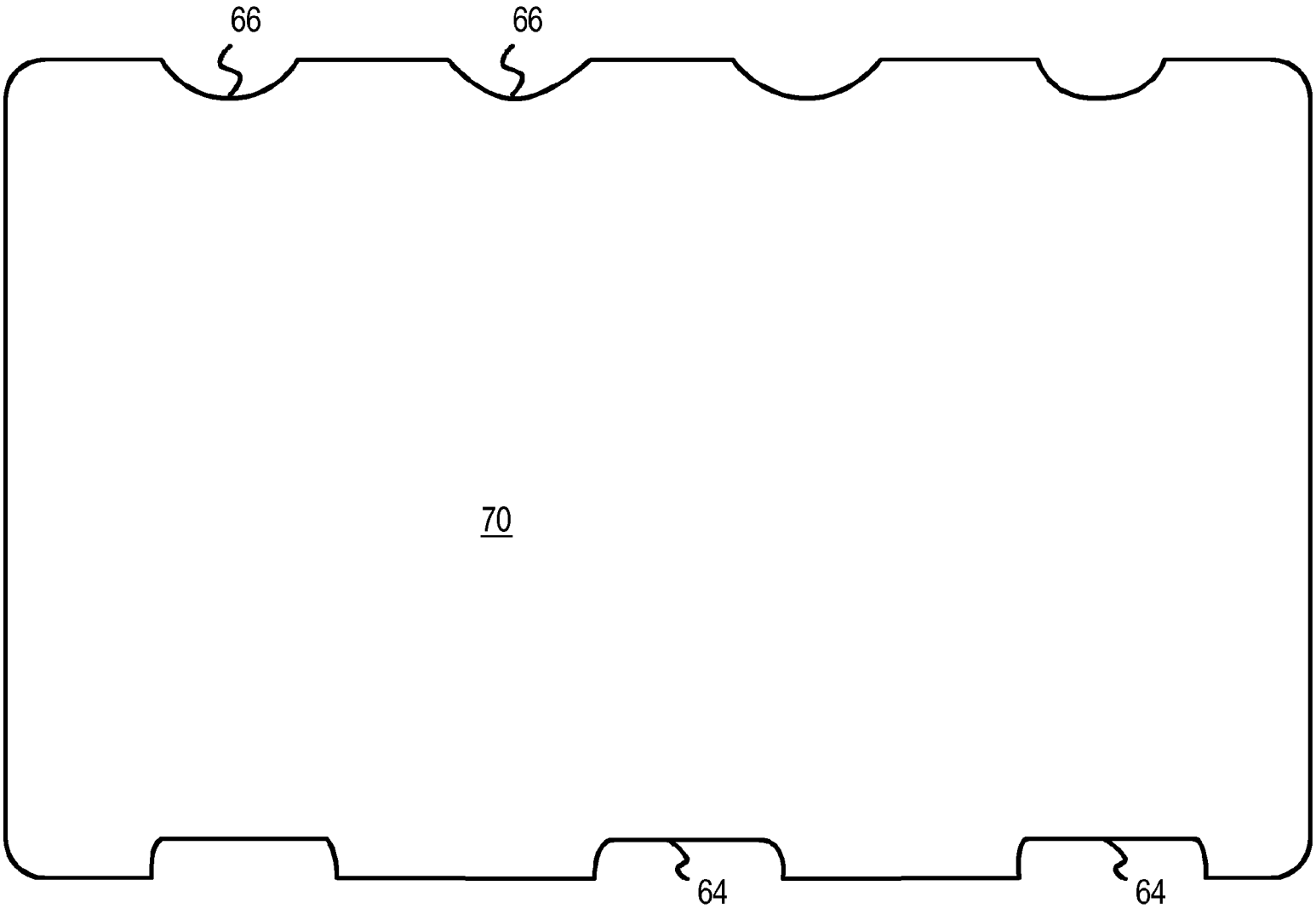
FIG. 8 shows the bottom plate with micro gripping cutouts.

FIG. 8 shows the bottom plate with micro gripping cutouts. Bottom plate 70 may be a plastic sheet having the length and width of a credit card. Micro gripping cutouts 66 are formed on one edge, while larger gripping cutouts 64 are formed on the opposing edge, to allow a person to better grip microSD card 34, Memory Stick Micro 32, SD card 36, or Memory Stick 38 to pull it out during removal.

Alternate Embodiments

Several other embodiments are contemplated by the inventors. For example, various indicia or patterns may be printed or formed on bottom plate 70 or top plate 30. A writable area may be formed to allow a person to write information, such as the person's phone number if the multi-standard flash-memory-card carrier is lost. Promotional items may be printed on the carrier. A compass, magnifying glass, or USB device may be added to the carrier. While flash memory cards have been described, the multi-standard flash-memory-card carrier could carry other devices that fit the flash-memory-card form factors, such as WiFi card devices.

While a multi-standard flash-memory-card carrier with two SD card bays 46, 46' and only one Memory Stick Duo/PRO Duo bay 48 has been described, the multi-standard flash-memory-card carrier could have two or three Memory Stick Duo/PRO Duo bays 48, or no Memory Stick Duo/PRO Duo bay 48 and three SD card bays 46. Likewise, different combinations and arrangements of microSD bay 44 and Memory Stick Micro (M2) bay 42 could be substituted. Bays for other kinds of flash-memory cards could be substituted, such as for future flash-memory-card standards.

While bottom plate 70 has been described as a separate plastic sheet from carrier spine 50, carrier spine 50 and bottom plate 70 could be formed together, such as by being a single molded piece, although spring-clip tabs 56 and spring side 62 in carrier spine 50 need to be movable and not bonded to bottom plate 70 to allow movement of the spring mechanism. While plastic plates have been described, carrier spine 50, bottom plate 70, and top plate 30 could be made from various kinds of plastic, metal, or various combinations. Clear plastic could be used for top plate 30 and/or bottom plate 70, or opaque plastic could be used. Additional pieces could be added. The multi-standard flash-memory-card carrier could be slid into a cover, or could have a removable cover, or attached to a lanyard to be worn as an ID card.

The background of the invention section may contain background information about the problem or environment of the invention rather than describe prior art by others. Thus inclusion of material in the background section is not an admission of prior art by the Applicant.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A multi-standard flash-memory-card carrier comprising:

a top cover;

a bottom cover;

a carrier spine, situated between the top cover and the bottom cover;

a first and a second set of openings formed on one side of the carrier spine and a third set of openings and a single opening formed on an opposite side of the carrier spine, wherein the first and the second set of openings are adjacent to each other and the third set of openings and the single opening are adjacent to each other, wherein each of the three sets of openings and the single opening is different in size and shape to receive four different types of flash memory cards;

a first set of deformable spring-clip fingers formed within the first set of openings, wherein each of the first set of deformable spring-clip fingers includes a first type of spring-clip tab to secure a first type of micro flash card;

a second set of deformable spring-clip fingers formed within the second set of openings, wherein each of the second set of deformable spring-clip fingers includes a second type of spring-clip tab to secure a second type of micro flash card;

a first deformable spring side formed around a first oval cavity on the opposite side of the carrier spine and within one of the third set of openings, wherein the first deformable spring side includes a first type of spring side tab to secure a third type of larger flash card; and a second deformable spring side formed around a second oval cavity on the opposite side of the carrier spine, wherein the second deformable spring side includes the first type of spring side tab on a first side that is within another of the third set of openings and a second type of spring side tab on a second side that is within the single opening to secure both the third type of larger flash card on the first side and a fourth type of larger flash card on the second side, wherein the first and the second side are on opposite sides of the second deformable spring side.

2. The multi-standard flash-memory-card carrier of claim 1, wherein the first and the second set of deformable spring-clip fingers secure the first and the second type of micro flash cards via the first and the second type spring-clip tabs that are inserted into notches of the first and the second type of micro flash cards once the first and the second type of micro flash cards are fully inserted into the one side of the carrier spine.

3. The multi-standard flash-memory-card carrier of claim 2, wherein the first and the second set of deformable spring-clip fingers are deformed away from the first and the second set of openings by the first and the second type of micro flash cards during insertion.

4. The multi-standard flash-memory-card carrier of claim 2, wherein the first and the second deformable spring sides secure the third and the fourth type of larger flash cards via the first and the second deformable spring sides that are inserted into notches of the third and the fourth type of larger flash cards once the third and the fourth larger flash cards are fully inserted into the opposite side of the carrier spine.

5. The multi-standard flash-memory-card carrier of claim 4, wherein the first and the second set of deformable spring sides are deformed inward thereby reducing a size of the first and the second oval cavities during insertion of third and the fourth type of larger flash cards.

6. The multi-standard flash-memory-card carrier of claim 2, further comprising:

micro gripping cutouts formed on the bottom cover and on the top cover near the first and the second set of openings to allow a person to grip the first and the second type of micro flash cards for removal from the multi-standard flash-memory-card carrier.

7. The multi-standard flash-memory-card carrier of claim 1, wherein the first type of micro flash card comprises a micro-SecureDigital (microSD) card, wherein the first set of openings are each sized with a microSD bay to receive the microSD card.

8. The multi-standard flash-memory-card carrier of claim 1, wherein the second type of micro flash card comprises a Memory Stick Micro card, wherein the second set of openings are each sized with a Memory Stick Micro (M2) bay to receive the Memory Stick Micro card.

9. The multi-standard flash-memory-card carrier of claim 1, wherein the third type of larger flash card comprises a SD card, wherein the third set of openings are each sized with a SD card bay to receive the SD card.

10. The multi-standard flash-memory-card carrier of claim 1, wherein the fourth type of larger flash card comprises a Memory Stick, wherein the single opening is sized with a Memory Stick Duo/PRO Duo bay to receive the Memory Stick.

11. The multi-standard flash-memory-card carrier of claim 1, wherein the first and the second set of openings and the third set of openings and the single opening are formed on opposite sides of the multi-standard flash-memory-card carrier.

* * * * *